US005720528A

United States Patent [19]

Ritchey

[11] Patent Number: 5,720,528

[45] Date of Patent: Feb. 24, 1998

[54] ROTATABLE CUTTING TOOL-HOLDER ASSEMBLY

[75] Inventor: Cary D. Ritchey, Curryville, Pa.

[73] Assignee: Kennametal Inc., Latrobe, Pa.

[21] Appl. No.: 768,873

[22] Filed: Dec. 17, 1996

[51] Int. Cl.[6] ..... E21C 35/197

[52] U.S. Cl. ..... 299/107

[58] Field of Search ..... 299/107, 109; 37/458, 459

[56] References Cited

U.S. PATENT DOCUMENTS

| | | | |
|---|---|---|---|
| 3,512,838 | 5/1970 | Kniff | 299/104 |
| 3,749,449 | 7/1973 | Krekeler | 299/102 |
| 3,830,321 | 8/1974 | McKenry et al. | 175/332 |
| 3,945,681 | 3/1976 | White | 299/107 |
| 4,299,424 | 11/1981 | LeBegue et al. | 299/103 |
| 5,011,229 | 4/1991 | O'Neil et al. | 299/102 |
| 5,040,850 | 8/1991 | Komotzki | 299/106 |
| 5,529,384 | 6/1996 | Ojanen et al. | 299/107 |

OTHER PUBLICATIONS

Strathclyde Limited Brochure, "Side Pull-Lock Tools and Toolholders", Leaflet 70–110 (Date unknown).

Yatskikh et al., Mining Machines and Systems, Gomye Mashiny Kompleksy, 4th Ed., (1974) Moscow Nedra, selected pages.

Carmet Minetools Brochure, Section 6 [Bits and Blocks], pp. 37–43, Catalog MT–76 (date unknown).

*Primary Examiner*—David J. Bagnell

*Attorney, Agent, or Firm*—John J. Prizzi

[57] ABSTRACT

A rotatable cutting tool-holder assembly which has a cutting tool having a forward and a rearward end. The cutting tool contains a groove adjacent to the rearward end thereof. A holder contains a bore therein wherein the bore has a forward opening and a rearward opening. The holder has a rearward surface. The holder presents a rearwardly extending boss from the rearward surface thereof. The cutting tool is carried in the bore so that the groove of the cutting tool extends rearwardly past of the rearward opening of the bore. A retention clip is received within the groove of the cutting tool and the boss engages the retention clip so as to retain the cutting tool within the bore of the holder so that the cutting tool is free to rotate relative to the holder.

13 Claims, 3 Drawing Sheets

ROTATABLE CUTTING TOOL-HOLDER ASSEMBLY

BACKGROUND OF THE INVENTION

In the past, a number of cutting tools (e.g., coal tools or construction tools) have been rotatably held within the bore of a holder (or block) by a clip or hose clamp that sits in an annular groove at the rear of the cutting tool. The clip or (hose clamp) was larger than the diameter of the bore so that the cutting tool was retained within the bore in such a manner that it was free to rotate relative to the holder.

While these earlier arrangements held the cutting tool in the holder, as well as permitted the cutting tool to rotate, operators experienced difficulty in the assembly and removal thereof. Typically, two persons were required to assemble and disassemble the clip onto and off of the cutting tool-holder assembly. In both cases, one person had to hold the cutting tool and the other person had to take the clip on or off of the cutting tool.

It should be appreciated that the need to use two persons to assembly or remove the clip resulted in an increase in the labor expenses associated with the use of the cutting tool. Using two persons also increased the difficulty and time needed to assemble or remove the clip.

It would thus be desirable to provide an arrangement wherein a cutting tool would be rotatably held within the bore of a holder (or block) by a clip wherein only one person would be needed to assemble or remove the cutting tool to or from the holder. To provide such an arrangement would increase the ease and speed of assembly or removal which would increase the overall efficiencies associated with such an arrangement.

SUMMARY OF THE INVENTION

In one form thereof, the invention is a rotatable cutting tool-holder assembly which has a cutting tool having a forward and a rearward end. The cutting tool contains a groove adjacent to the rearward end thereof. A holder contains a bore therein wherein the bore has a forward opening and a rearward opening. The holder has a rearward surface. The holder presents a rearwardly extending boss from the rearward surface of the holder. The cutting tool is carried in the bore so that the groove extends rearwardly past the rearward opening of the bore. A retention clip is received within the groove of the cutting tool and the boss engages the retention clip so as to retain the cutting tool within the bore of the holder so that the cutting tool is free to rotate relative to the holder.

BRIEF DESCRIPTION OF THE DRAWINGS

The following is a brief description of the drawing figures which form a part of this patent application.

DETAILED DESCRIPTION

Figure 1:
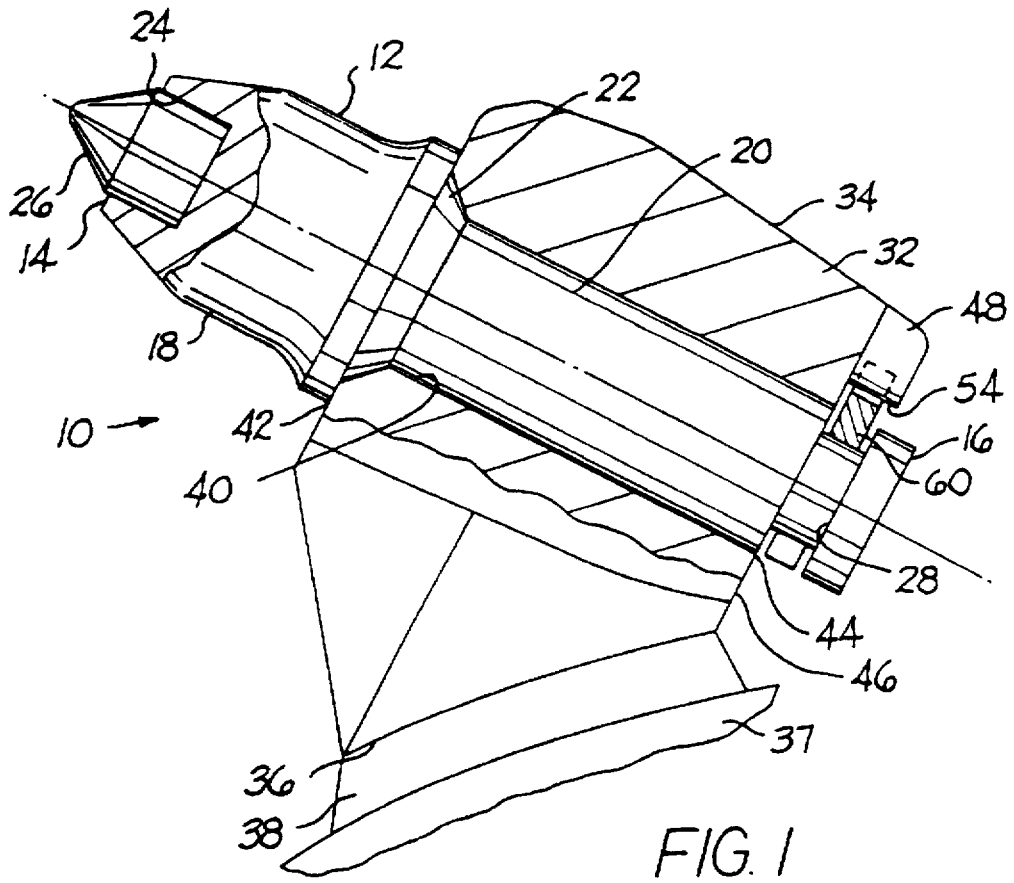
FIG. 1 is side view of a specific embodiment of the invention with the retention clip rotatably retaining the cutting tool within the bore of the holder, and wherein a portion of the holder is cut away, a portion of the retention clip is cut away, and a portion of the cutting tool is cut away.

Referring to the drawings, there is illustrated in FIG. 1 a rotatable cutting tool-holder assembly which includes a cutting tool generally designated as 10. Cutting tool 10 has an elongate cutting tool body 12 of a generally cylindrical geometry and with opposite axially forward 14 and rearward ends 16. Cutting tool body 12 has a forward head portion 18 and a rearward shank portion 20. A shoulder 22 separates the head portion 18 from the shank portion 20.

Figure 2:
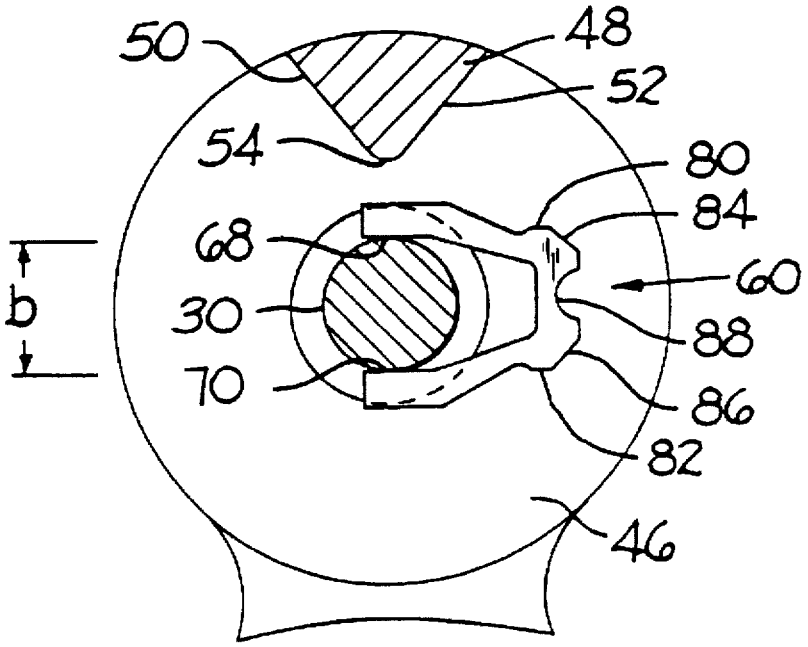
FIG. 2 is a rear view of the specific embodiment of FIG. 1, except that a different portion of the holder is cut away and the retention clip is positioned where it is initially received within the groove of the cutting tool as the first step in the assembly of the retention clip onto the cutting tool-holder assembly.

Cutting tool 12 contains a generally cylindrical socket 24 at the forward end 14 thereof. A plug-style hard insert 26 is affixed within the socket 25 in the forward end 14 of the cutting tool 12 by brazing or the like. Cutting tool body 12 contains an annular groove 28 therein adjacent to the rearward end 16 thereof. Annular groove 28 defines a reduced diameter portion 30 of the cutting tool body 12 wherein the reduced diameter portion 30 has a diameter "b" as illustrated in FIG. 2.

The cutting tool-holder assembly further 5 includes a holder (or block) 32 which has a top surface 34 and a bottom surface 36. Holder 32 is affixed at its bottom surface 36 to a rotating drum 37 (or other type of driving member) by a weldment 38 or the like. Holder 32 contains a central bore 40 which has a forward opening 42 and a rearward opening 44. Holder 32 has a rearward surface 46 from which a boss 48 extends rearwardly therefrom so as to be preferably near to the rearward opening 44. Boss 48 includes a pair of opposite inclined surfaces (50, 52) and a convex protrusion 54. Inclined surfaces 50 and 52 are disposed with respect to each other at an angle of about 90 degrees. While the boss 48 is depicted as being an integral part of the holder 32, the applicant contemplates that the boss 48 may be a separate part attached to the holder 32 by a bolt(s), a screw(s), or some other way of attachment.

Figure 4:
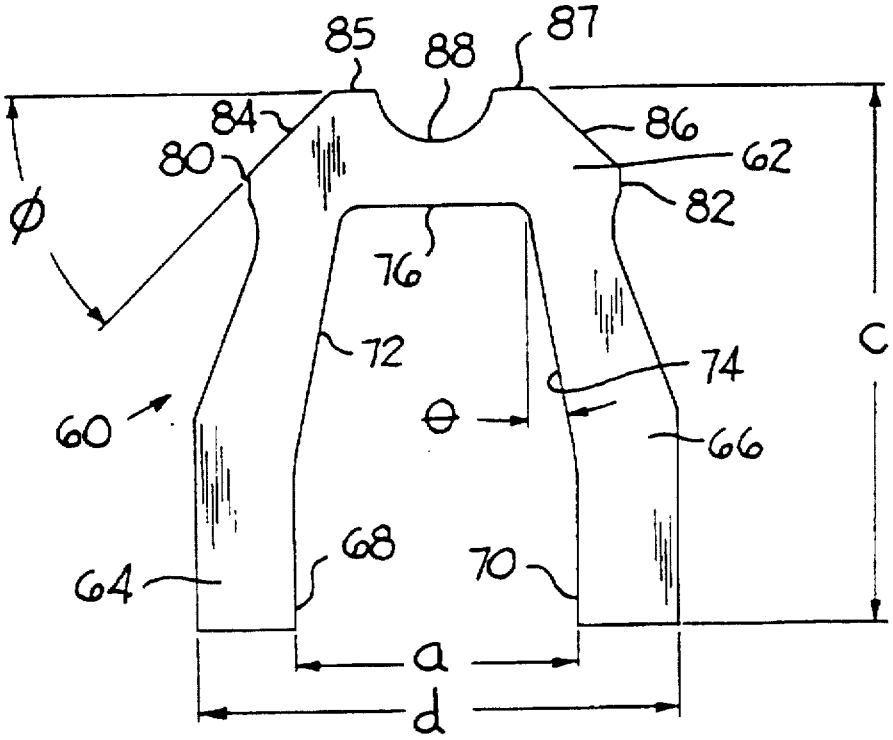
FIG. 4 is a front view of the retention clip of FIG. 1.

The cutting tool-holder assembly also includes a retention clip 60 which may be made from steel, aluminum, or other metallic or plastic (e.g., nylon) material, or a combination of the foregoing materials, suitable for a specific application so as to possess the desired wear, flexibility, and fatigue resistance properties. The retention clip 60 may be fabricated by stamping or bending, or may otherwise be formed, to the desired size and shape. As shown in FIG. 4, retention clip 60 includes a mediate portion 62 from which project a pair of integral legs 64 and 66. Legs 64 and 66 have opposite interior generally parallel distal edges 68 and 70, respectively. Legs 64 and 66 also have opposite interior converging edges 72 and 74. Each one of the interior converging edges (72, 74) is disposed at an angle with respect to the vertical. Angle preferably is about 15 degrees. A transverse edge 76 joins the ends of the converging edges 72 and 74 that are adjacent to the mediate portion 62.

The mediate portion 62 of the retention clip 60 presents opposite flat edges 80 and 82 which are generally vertically disposed as viewed in FIG. 4. Mediate portion 62 further includes opposite cam surfaces 84 and 86 which are joined to the arcuate notch 88 by a pair of opposite flat surfaces 85 and 87, respectively. As viewed in FIG. 4, each one of the cam surfaces (84, 86) is disposed at an angle with respect to the horizontal. The preferred angle is about 45 degrees.

Figure 5:
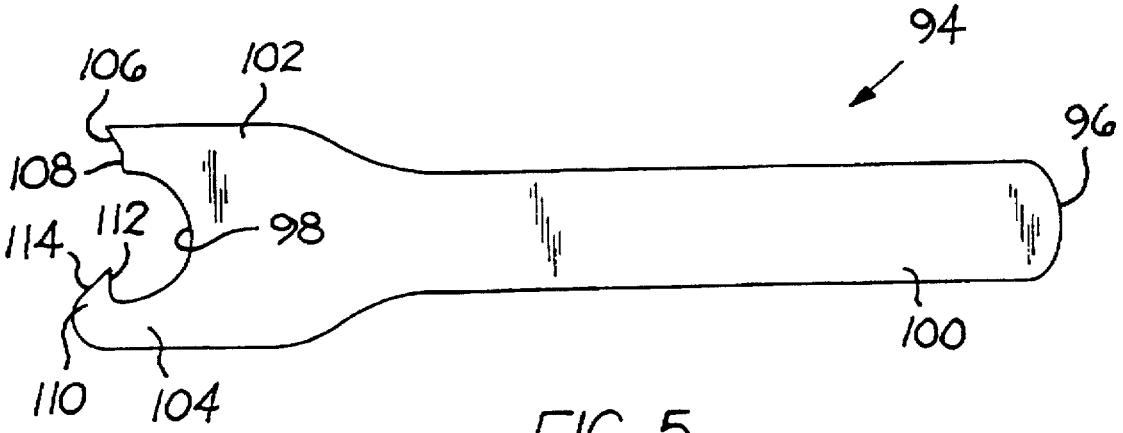
FIG. 5 is a front view of a puller used to assemble and remove the retention clip from the cutting tool-holder assembly.

A puller, as shown in FIG. 5, generally designated as 94 facilitates the assembly and removal of the retention clip 60, as will be discussed hereinafter. Puller 94 has opposite ends 96 and 98 wherein there is a handle 100 at the one end 96 thereof and a pair of prongs 102 and 104 at the other end 98 thereof. The distal surface of one prong 102 has an inclined edge 106 and a transverse edge 108. The other prong 104 has a hook 110 thereat wherein the hook 110 has an interior edge 112 and an exterior edge 114.

In order to assembly the retention clip 60 to the cutting tool-block assembly, the retention clip 60 is slid onto the tool bit body such that the legs 64, 66 of the clip 60, and more specifically, the opposite generally parallel distal edges 68, 70 are received within the groove 28. The distance "a" (see FIG. 4), e.g., 0.66 inches (1.68 centimeters [cm]), between the generally parallel distal edges 68, 70 is greater (most preferably slightly greater, e.g., 0.02 inches (0.051 cm) on a diameter, than the diameter "b" (see FIG. 2), e.g., 0.64 inches (1.62 cm), of the reduced diameter portion 30 of the cutting tool body 12 defined by the groove 28 so that the retention clip 60 may be rotated from the position depicted in FIG. 2 to the position depicted in FIG. 3. A retention clip 60 which has the above-mentioned dimensions "a" and "b" may, for example, have an overall length "c" (see FIG. 4) of 1.04 inches (2.64 cm) and a width "d" (see FIG. 4) of 1.02 inches (2.59 cm).

Figure 3:
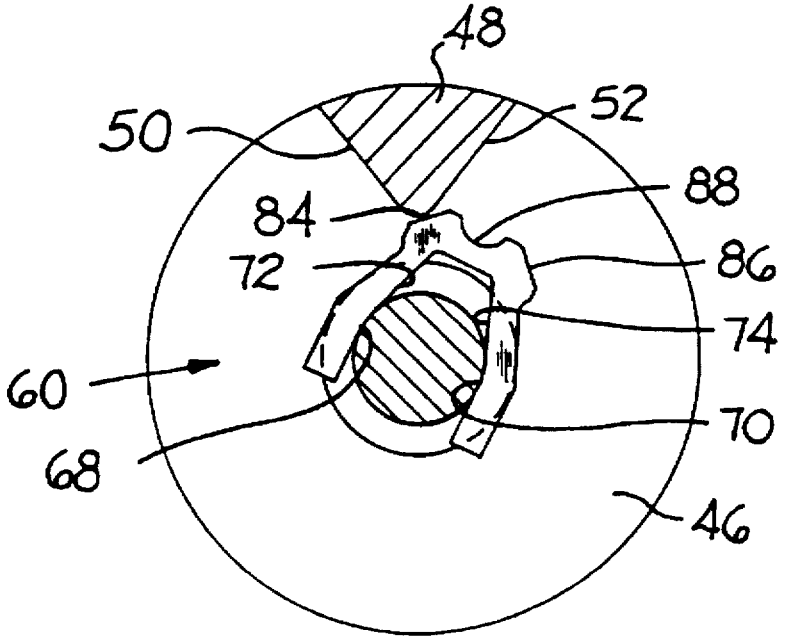
FIG. 3 is rear view of like that of FIG. 2 except that retention clip has been rotated counter-clockwise to a position wherein the boss engages the cam surface.

FIG. 3 depicts the retention clip 60 at the point where the protrusion 54 of the boss 48 engages the cam surface 84. At this point in the assembly of the retention clip 60 onto the cutting tool-holder assembly, the reduced diameter portion 30 of the tool body has not acted upon the interior converging edges 72, 74 of the legs 64, 66, respectively. As the retention clip 60 is further rotated (in a counterclockwise direction as viewed in FIGS. 2 and 3) to assemble the same on the cutting tool-holder assembly, the boss 48 (and more specifically the protrusion 54) acts on the cam surface 84 so as to force the retention clip 60 toward the cutting tool body thereby causing the reduced diameter portion 30 to engage the interior converging edges 72, 74. Because the distance between the interior converging edges is less than the diameter of the reduced diameter portion 30, such engagement causes the legs 64, 66 to spread apart. However, because the legs 64, 66 want to move back to their original position, the resiliency of the legs 64, 66 essentially urges the retention clip 60 upwardly toward the boss 48. As the retention clip 60 is rotated further, the protrusion 54 of the boss 48 will rest against the flat surface 85. Further rotation then causes the protrusion 54 of the boss 48 to be received within the notch 88, which is the position of the retention clip 60 shown in FIG. 6. Although the above description describes the direction of rotation of the retention clip 60 as being counter-clockwise, it should be appreciated that the retention clip 60 may be oriented so as to be rotated in a clockwise direction (as viewed in FIGS. 2 and 3) to assemble the retention clip 60 on the cutting tool-holder assembly.

The dimensioning of the retention clip 60 relative to the boss 48 and the reduced diameter portion 30 of the cutting tool body 12 is such that the reduced diameter portion 30 engages the interior converging edges 72, 74 so as to spread the legs 64, 66 apart thereby urging the retention clip 60 into engagement with the boss 48. The retention clip 60 is now securely assembled onto the cutting tool-holder assembly in such a fashion so as to permit the cutting tool to freely rotate relative to the holder without the loss of the cutting tool during use (e.g., coal mining, road milling, asphalt reclamation).

More specifically, the legs 64, 66 of the retention clip 60 are each received within the groove 28 so as to restrain movement of the retention clip 60 in a direction parallel to the longitudinal axis of the cutting bit 10. The resiliency of the legs (64, 66) urges the retention clip 60 upwardly so that the protrusion 54 of the boss 48 firmly engages the notch 88 so as to restrain movement of the retention clip 60 in a direction transverse to the longitudinal axis of the cutting bit 10. Hence, the retention clip 60 is very securely assembled to the cutting tool-holder assembly. Furthermore, the contact between the reduced diameter portion 30 of the cutting bit 10 and the legs 64, 66 of the retention clip 60 is such so as to permit the cutting tool 10 to freely rotate relative to the holder 32.

The retention pin 60, which has an overall size that is greater than the diameter of the bore 40, can abut against the rearward surface 46 of the holder 32 so as to restrict the movement of the cutting tool 10 axially forwardly out of the bore 40. The shoulder 22 of the cutting tool body 12 can abut against the portion of the holder 32 that surrounds the forward opening 42 of the bore 40 so as to restrict the movement of the cutting tool 10 axially rearwardly out of the bore 40. Hence, the movement of the cutting tool 10 out of the bore 40 in either direction is restrained so as to securely, yet rotatably, maintain the cutting tool 10 within the bore 40 of the holder 32.

To disassemble the retention clip 60 from the cutting tool-holder assembly, the retention clip 60 may be rotated in either direction (i.e., clockwise or 10 counter-clockwise) so as to first disengage the boss 48 from the notch 88. The retention clip 60 then may be rotated farther until it is entirely free of the boss 48.

Figure 6:
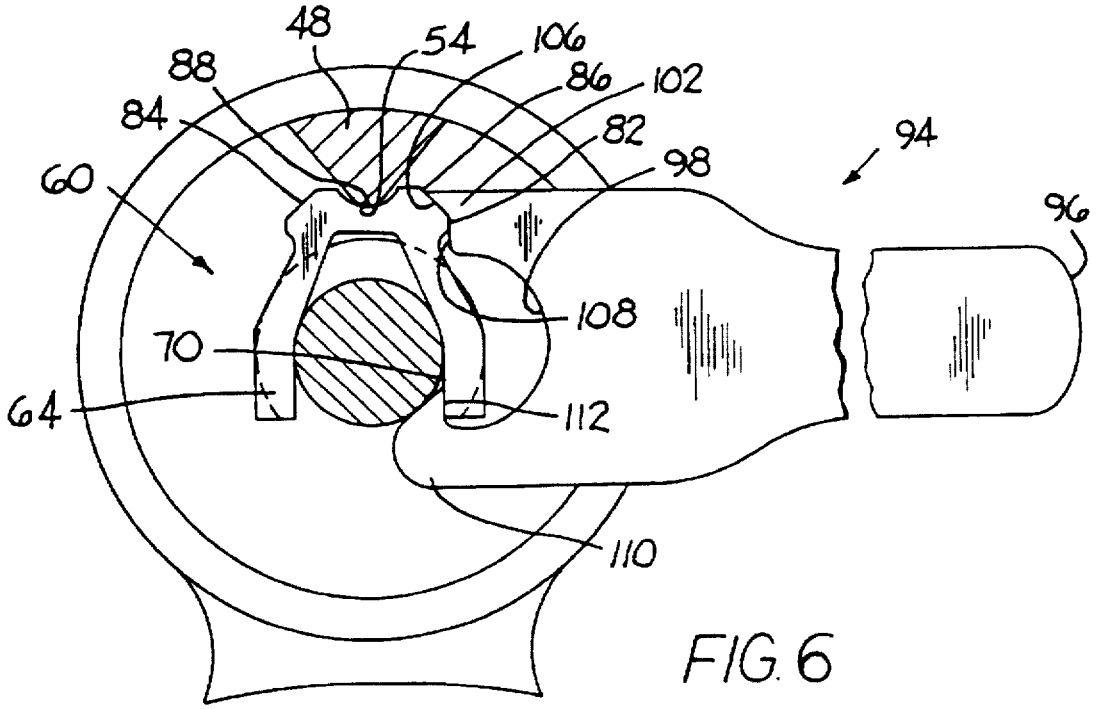
FIG. 6 is a rear view of the specific embodiment of FIG. 1, except that a different portion of the holder is cut away and the puller is illustrated as being in engagement with the retention clip.

While it not an absolute necessity, the use of the puller 94 will facilitate the assembly and removal of the retention clip 60. Referring to FIG. 6., the puller 94 engages the retention clip 60 in the following fashion. The inclined edge 106 of the one prong 102 engages the cam surface 86 and the transverse edge 108 of the one prong 102 engages the flat edge 82. The interior edge 112 of the hook 110 engages the interior distal edge 70. The puller 94 now securely holds the retention clip 60 so that the operator through the use of the puller 94 can rotate the retention clip 60 in a counter-clockwise direction as viewed in FIG. 6 so as to either assemble or disassemble the retention clip to or off of the cutting tool-holder assembly. Although the above description describes the direction of rotation of the puller 94 and the retention clip 60 as being counter-clockwise, it should be appreciated that the puller 94 and the retention clip 60 may be oriented so as to be rotated in a clockwise direction (as viewed in FIGS. 2 and 3) to assemble the retention clip 60 on the cutting tool-holder assembly. It should be appreciated that FIG. 6 depicts the puller 94 engaging the retention clip 60 either after assembly onto the cutting tool-holder assembly or prior to removal of the retention clip from the cutting tool-holder assembly.

While the above description pertains to a structure in which the cutting tool has a groove which 5 receives the legs of the retention clip and the holder has a boss with a protrusion which engages the notch in the retention clip, applicant contemplates a structure wherein the holder has a boss which contains a notch. The notch in the boss receives a protrusion projecting from the retention clip. The cutting tool still contains a groove which receives the legs of the retention clip.

From the foregoing it is clear that with the present invention, the retention clip 60 can be easily assembled and disassembled on or off of the cutting tool-holder assembly by one person. Depending upon the stiffness or hardness of the retention clip 60 and boss 48, the assembly or disassembly of the retention clip 60 can be performed by one person using bare hands or with the puller 94 as shown by FIG. 6.

The patents and other documents identified herein are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A rotatable cutting tool-holder assembly comprising:

a cutting tool having a forward and a rearward end, and the cutting tool containing a groove adjacent to the rearward end thereof;

a holder containing a bore therein wherein the bore has a forward opening and a rearward opening, the holder having a rearward surface, and the holder presenting a rearwardly extending boss from the rearward surface thereof;

the cutting tool being carried in the bore so that the groove of the cutting tool extends rearwardly past of the rearward opening of the bore; and a retention clip being received within the groove of the cutting tool and the boss engaging the retention clip so as to retain the cutting tool within the bore of the holder so that the cutting tool is free to rotate relative to the holder.

2. The rotatable cutting tool-holder assembly of claim 1 wherein the retention clip includes a pair of legs projecting from an integral mediate portion, the mediate portion containing a notch; and the legs being received within the groove, and the boss engaging the notch.

3. The rotatable cutting tool-holder assembly of claim 2 wherein the legs include opposite generally parallel interior distal edges and opposite generally converging interior edges contiguous with the mediate portion wherein the converging interior edges converge as they move toward the mediate portion; and the mediate portion further including a cam surface.

4. The rotatable cutting tool-holder assembly of claim 3 wherein the cutting tool is generally cylindrical; the groove extending around the circumference of the cutting tool so that the cutting tool has a reduced diameter portion at the location of the groove; the distance between the interior distal edges of the legs being greater than the diameter of the reduced diameter portion of the cutting tool; and the distance between the converging interior edges decreasing from being greater than the diameter of the reduced diameter portion of the cutting tool to being less than the diameter of the reduced diameter portion of the cutting tool.

5. The rotatable cutting tool-holder assembly of claim 4 wherein the legs are flexible; and when the boss engages the notch the converging interior edges of the legs engage the reduced diameter portion of the tool body so as to urge the retention clip against the boss.

6. The rotatable cutting tool-holder assembly of claim 4 wherein when the retention clip is assembled on the cutting tool, the portions of the legs defining the distal edges being received within the groove so that the retention clip can be moved to where the boss engages the cam surface so as to force the converging interior edges against the reduced diameter portion of the cutting tool.

7. The rotatable cutting tool-holder assembly of claim 2 wherein the mediate portion presents a cam surface on either side of the notch.

8. The rotatable cutting tool-holder assembly of claim 1 wherein the retention clip including a pair of flexible legs projecting from an integral mediate portion, the mediate portion containing a notch therein; the cutting tool having a reduced diameter portion at the location of the groove; and when the boss engages the notch the legs are moved against the reduced diameter portion of the cutting tool so as to urge the retention clip against the boss.

9. A retention clip for use with a cutting tool with a forward and rearward end having a groove adjacent to the rearward end thereof wherein the cutting tool has a reduced diameter portion at the location of the groove, and a holder containing a bore with a forward opening and a rearward opening, the holder having a rearward surface, the holder presents a rearwardly extending boss from the rearward surface thereof, and the cutting tool being carried in the bore so that the groove extends rearwardly past of the rearward opening of the bore, the retention clip comprising:

a pair of legs projecting from an integral mediate portion, the mediate portion containing a notch; and the legs being received within the groove, and the boss engaging the notch so as to retain the cutting tool within the bore of the holder so that the cutting tool is free to rotate relative to the holder.

10. The retention clip of claim 9 wherein the legs include opposite generally parallel interior distal edges and opposite generally converging interior edges contiguous with the mediate portion wherein the converging interior edges converge as they move toward the mediate portion; and the mediate portion further including a cam surface to a side of the notch.

11. The retention clip of claim 10 wherein the distance between the interior distal edges of the legs being greater than the diameter of the reduced diameter portion of the cutting tool; and the distance between the converging interior edges decreasing from being greater than the diameter of the reduced diameter portion of the cutting tool to being less than the diameter of the reduced diameter portion of the cutting tool.

12. The retention clip of claim 9 wherein the mediate portion having a pair of cam surfaces wherein one of the cam surfaces is on each side of the notch.

13. A holder for use with a cutting tool with forward and rearward ends and having a groove adjacent to the rearward end thereof wherein the cutting tool has a reduced diameter portion at the location of the groove, and a retention clip having a pair of legs projecting from an integral mediate portion containing a notch, and wherein the legs are received within the groove; the holder comprising:

a holder body;

the holder body containing a bore with a forward opening and a rearward opening, the holder body having a rearward surface, and the holder body presenting a rearwardly extending boss from the rearward surface thereof, and the cutting tool being carried in the bore so that the groove extends rearwardly past of the rearward opening of the bore: and the boss engaging the notch so as to retain the cutting tool within the bore of the holder so that the cutting tool is free to rotate relative to the holder.

* * * * *